United States Patent [19]

Goller et al.

[11] Patent Number: 4,481,795

[45] Date of Patent: Nov. 13, 1984

[54] MECHANISM FOR FLAT KNITTING MACHINES AND AN OPERATING METHOD FOR THE TAKING DOWN OF SHAPED KNITTED PRODUCTS

[75] Inventors: Ernst Goller, Reutlingen; Günther Kazmaier, St. Johann-Ohnastetten; Hans D. Trissler, Reutlingen, all of Fed. Rep. of Germany

[73] Assignee: H. Stoll GmbH & Co., Reutlingen, Fed. Rep. of Germany

[21] Appl. No.: 457,953

[22] Filed: Jan. 14, 1983

[30] Foreign Application Priority Data

Mar. 16, 1982 [DE] Fed. Rep. of Germany ..... 3209480

[51] Int. Cl.[3] ..... D04B 15/88

[52] U.S. Cl. ..... 66/150

[58] Field of Search ..... 66/149 R, 150, 152

[56] References Cited

U.S. PATENT DOCUMENTS 3,618,343 11/1971 Essig ..... 66/149

*Primary Examiner*—Ronald Feldbaum

*Attorney, Agent, or Firm*—Larson and Taylor

[57] ABSTRACT

For the purpose of taking down shaped knitted products from a flat knitting machine the take-down mechanism comprises an auxiliary take-down roller (18) disposed in advance of the take-down roller (16), and this can have a superimposed take-down motion intermittently imparted thereto by means of an auxiliary driving device. To increase the effectiveness of the auxiliary take-down roller (18), the last course of separating stitches formed on one needle bed can be pressed off between two successive shaped knitted pieces (43) before the taking down of a double-sided separating knitting section (45).

7 Claims, 4 Drawing Figures

MECHANISM FOR FLAT KNITTING MACHINES AND AN OPERATING METHOD FOR THE TAKING DOWN OF SHAPED KNITTED PRODUCTS

This invention relates to a mechanism for flat knitting machines for taking down shaped knitted products, this comprising a driven main take-down roller and an auxiliary take-down roller which precedes it in the take-down direction, is arranged adjacent the stitch forming area, and coupled to the drive of the main take-down roller, and an operating method for taking down the shaped knitted products by a mechanism of this nature.

It is already known to provide the take-down mechanism of flat knitting machines with additional take-down members which are disposed as near as possible to the stitch formation area to provide for early engagement of the knitted product. The auxiliary take-down members may be take-down rollers or belts (DE OS 3025008). In the making of shaped knitted products, that is to say knitted products which, to avoid yarn waste, are given their basic shape on the flat knitting machines by narrowing and widening, particular problems for the take-down mechanism are met with at the transition from narrow shaped knitted parts to the wider beginning of the part of a succeeding knitted product. It is known on a flat knitting machine to make a plurality of shaped knitted parts simultaneously alongside and divided from one another by separating knitted pieces, or one after another, that is to say in sequence. Where a shaped knitted piece finishes with a narrow edge, for example a narrow collar part, the tension imposed by the take-down mechanism is first concentrated on this narrow end part of the knitted product. Until a wider starting edge part of a subsequent shaped knitted piece is engaged by the take-down mechanism there is a sharp contraction of the wide starting edge of the next knitted piece by the take-down force which has been applied only over the narrow terminal edge of the previous shaped piece. The quality of this next knitted piece is negatively influenced by a non-uniform straining of the starting edge of a shaped knitted piece in this way.

The object of the present invention is to provide a take-down mechanism and a method of taking down shaped knitted products in which the take-down strain is distributed over the full width of the oncoming knitted piece even in cases where there are large jumps between succeeding knitted pieces at the transition between them.

The object set by this invention is achieved in a mechanism of the type first set forth above by the fact that the auxiliary take-down roller to impart a superimposed rotary motion is provided, at least in the take-down direction, with an auxiliary driving device which can be operated intermittently through a control arrangement through a clutch capable of assuming a free wheel status.

This superimposed rotary motion imparts an accelerated drawing off of the knitted piece to be taken down. As a result, in the above-mentioned transitions from a narrow shaped knitted end to a wider shaped knitted beginning there is a rapid take-up of this beginning over the separating knitted area between succeeding shaped knitted pieces and, with it the application of the take-down force at the beginning of the next successive shaped knitted piece over the full width of the latter. Using the mechanism constructed in accordance with this invention a superimposed take-down motion with the effect of increasing, or perhaps decreasing, the take-down loading on the knitted fabric can be applied temporarily at other parts of the knitting formed and this can be of advantage in the making of other knitting patterns.

The auxiliary driving device may be a separate motor which, through a clutch capable of adopting a free wheel status can be coupled for example directly with an auxiliary take-down roller, the control arrangement acting either on the motor or on the clutch. The auxiliary driving device may however also be a driving part of the knitting machine itself, for example a control shaft with which the auxiliary take-down roller is directly or indirectly drivingly coupled through a control clutch. Also the clutch capable of adopting an idling position can be of different construction. An electromagnetically-operated clutch or a so-called loop spring clutch can be used. Also the control device can take different forms.

With the problem with which the invention is primarily concerned, viz. that of achieving a starting pull as uniform as possible over the full width of the wide spread of the now shaped knitted piece where there is an abrupt change in width between successive pieces, and avoiding a twisted pull on the edge of this new piece, in a particularly advantageous arrangement the following operating procedure is used to take down successive shaped knitted pieces connected through separating knitted sections:

(a) after a double-sided separating knitted section has been made the stitches of the last course of stitches of the separating section made on one needle bed are pressed off and (b) at the same time or following thereon the auxiliary driving device for the auxiliary take-down roller is operated to produce an additional superimposed take-down rotation of the auxiliary take-down roller.

After pressing off of the stitches of the last separating stitch course made on one of the two needle beds, as a result of the strain of the auxiliary take-down roller there is a release of the stitch ends containing the pressed off stitches, this leading to a longitudinal stretching of the separating knitted section to about three times its length. During this release of the stitch ends the separating knitted section exerts no appreciable resistance to the increased pull-down movement of the auxiliary take-down roller so that, even where there is a very sizeable jump in width between successive knitted pieces over the range of the separating knitting between these successive pieces the interposed delay until the wide starting edge of the next shaped piece is engaged can be absorbed and the wide starting edge of the shaped knitted piece immediately subjected over its full width to the take-down power of the take-down mechanism.

An exemplary embodiment of a take-down mechanism constructed in accordance with the invention will now be described in more detail with reference to the accompanying more or less diagrammatic drawings.

Figure 1:
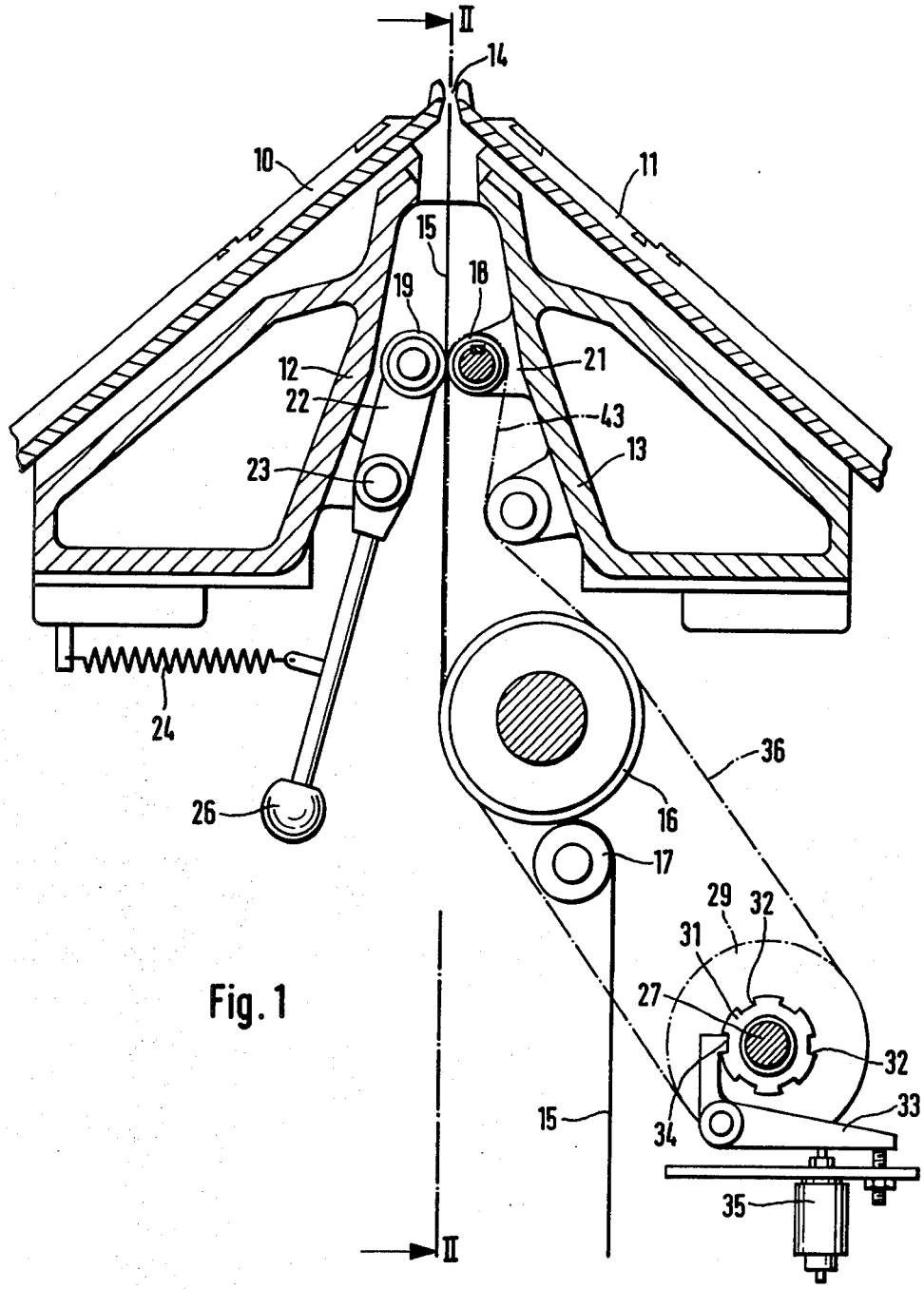
FIG. 1 is a diagrammatic cross section through a V-bed flat knitting machine with a take-down mechanism in accordance with the invention.

FIG. 1 shows the two needle beds 10 and 11 of a flat knitting machine and the associated needle bed frame supports 12 and 13. Disposed beneath the comb gap 14 and thus beneath the knitting area of the machine is a mechanism for taking down the fabric, which latter is depicted by the full line 15.

The take-down mechanism comprises a main take-down roller 16 of known type and this cooperates with a press roller 17. The take-down mechanism also includes an auxiliary take-down roller 18 which is disposed below the comb gap 14 between the two frame supports 12 and 13 and cooperates with a press roller 19. The driving shafts 16*a*, 18*a* of the main take-down roller 16 and of the auxiliary take-down roller 18 are—as will be fully described later—operatively and permanently coupled together and turn at the same rotary speed. The main take-down roller 16 is driven, in a manner not illustrated, by a rotary field magnet motor. The main take-down roller 16 and the auxiliary roller 18 each have a profiled surface to engage the knitted width or widths 15 to be taken down and these may be made up of individual roller sections.

This also applies to the press roller 19 working with the auxiliary take-down roller 18.

Whilst the auxiliary take-down roller 18 is mounted on rigid carrier arms 21 the carrier arm 22 for rthe press roller 19 is bifurcated and mounted by a pivot pin 23 so that it can be pivoted on the machine by means of an electric motor, or manually through a handle 26, so as to lift the press roller 19 away against compression springs 24.

Figure 2:
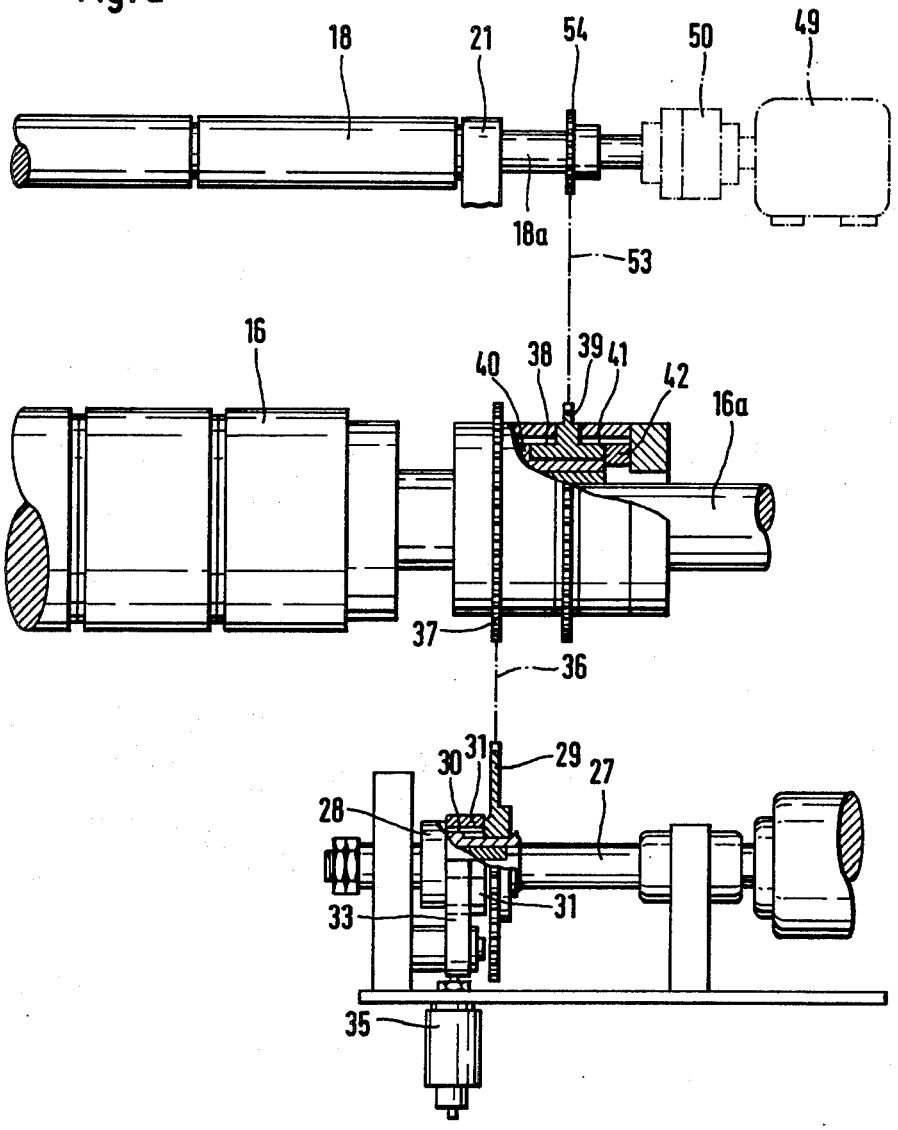
FIG. 2 is a partial side view of a part of the take-down mechanism shown in FIG. 1, this view being taken from the plane II—II.

As shown in FIGS. 1 and 2 the auxiliary take-down roller 18 is coupled with an additional driving unit by which a take-down speed different from that of the main roller 16 can be imparted intermittently to it under the command of a control unit not shown. In the embodiment illustrated the motivating part of this auxiliary driving means is a control shaft 27 of the flat knitting machine. As shown in FIG. 2 this control shaft 27 has thereon a driven bearing sleeve 28 on which a chain wheel 29 is rotatably mounted. A hub of this chain wheel 29 is coupled to the bearing sleeve 28 through a so-called loop spring clutch 30. This clutch comprises a cylindrical helical spring disposed around the parts which are to be coupled. Loop spring clutches of this nature are effective to provide a drive coupling in one direction of rotation to allow free wheeling in the opposite direction. One end of the loop spring is anchored to a concentric stop wheel 31 in a manner not here shown. Engaged in the spaced notches 32 of this wheel 31 is a catch 34 formed at the end of a two-armed pivot lever 33. The lever 33 is subject to the action of an electromagnet 35 which when energised pivots the locking catch 34 out of the notches 32 of the wheel 31.

The chain wheel 29 is coupled (see FIGS. 1 and 2) with a chain wheel 37 rotatably mounted on the shaft 16*a* of the main take-down roller 16 through an endless chain 36 shown in dotted lines.

The chain wheel 37 is coupled, through a loop spring clutch 38 of the previously-described character with a coaxial chain wheel 39 which is rotatably arranged on a bearing sleeve 40 non-rotatably connected to the shaft 16*a* of the main take-down roller 16. On the other hand the chain wheel 29 is coupled through a further loop spring clutch 41 with a driving disc 42 rotatably arranged on the shaft 16*a*. The chain wheel 39 is coupled by a chain 53 (shown in dotted lines) with a chain wheel 54 secured on the shaft 18*a* of the auxiliary driving roller 18.

The two loop spring clutches 38 and 41 associated with the main take-down roller 16, which in one direction of rotation will produce a coupling and in the other direction of rotation an idling effect, are so constructed and arranged that when the chain 36 is stationary the chain wheel 39 is only coupled to the ring 42 through the clutch 41 and thereby participates in the rotation of the driven shaft 16*a* of the main take-down roller 16. This movement is transmitted through the chain 53 and the chain wheel 54 to the shaft 18*a* of the auxiliary take-down roller 18.

If the stop wheel 31 is released by operation of the electromagnet 35 it will participate through the loop spring clutch 30 of the control shaft 27 through a rotary step determined by the mutual spacing of the notches 32 of the wheel 31. The chain wheel 29 also participates in this rotary step and this motion is transmitted through the chain 36 to the chain wheel 37. The rotary step of the chain wheel 37 is transmitted through the loop spring clutch 38 to the chain wheel 39 which is already turning at the speed of the shaft 16*a* of the main take-down roller 16. The loop spring clutch 41 permits an overtaking movement of the chain wheel 39 relatively to the driving ring 42 so that the rotary stepping movement transmitted through the clutch 38 to the chain wheel 39 can be transmitted as an additive movement to the chain wheel 39. Corresponding to this the auxiliary roller 18 makes a faster take-down movment than that of the main take-down roller 16 during this rotary stepping period and consequently brings about a faster take-down of the knitted web 15 than was previously the case. The rotary field motor operating the main take-down roller 16 adapts itself to this augmented take-down of the knitted web 15.

The auxiliary driving mechanism is not necessarily confined to a control shaft in the flat knitting machine. It could, as indicated by the auxiliary motor shown in dotted lines in FIG. 2, be coupled directly to the shaft 18*a* of the auxiliary take-down roller 18 through a clutch 50 allowing for a clutching or an alternative idling position.

Figure 3:
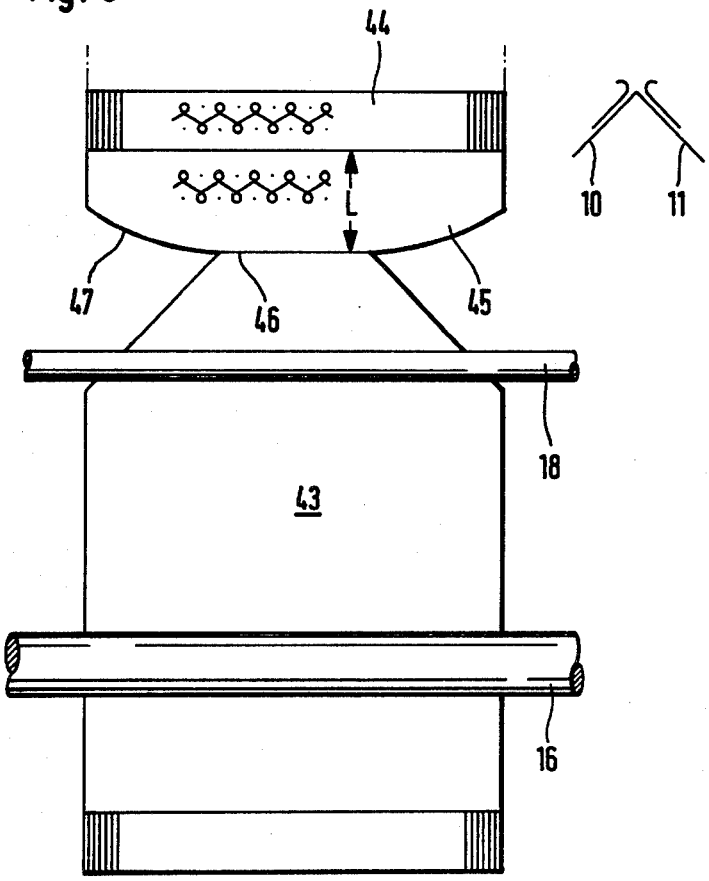
FIG. 3 is a diagrammatic illustration of a shaped knitted piece engaged by the take-down mechanism and showing the connecting part formed for separation at the commencement of a subsequent shaped piece.
Figure 4:
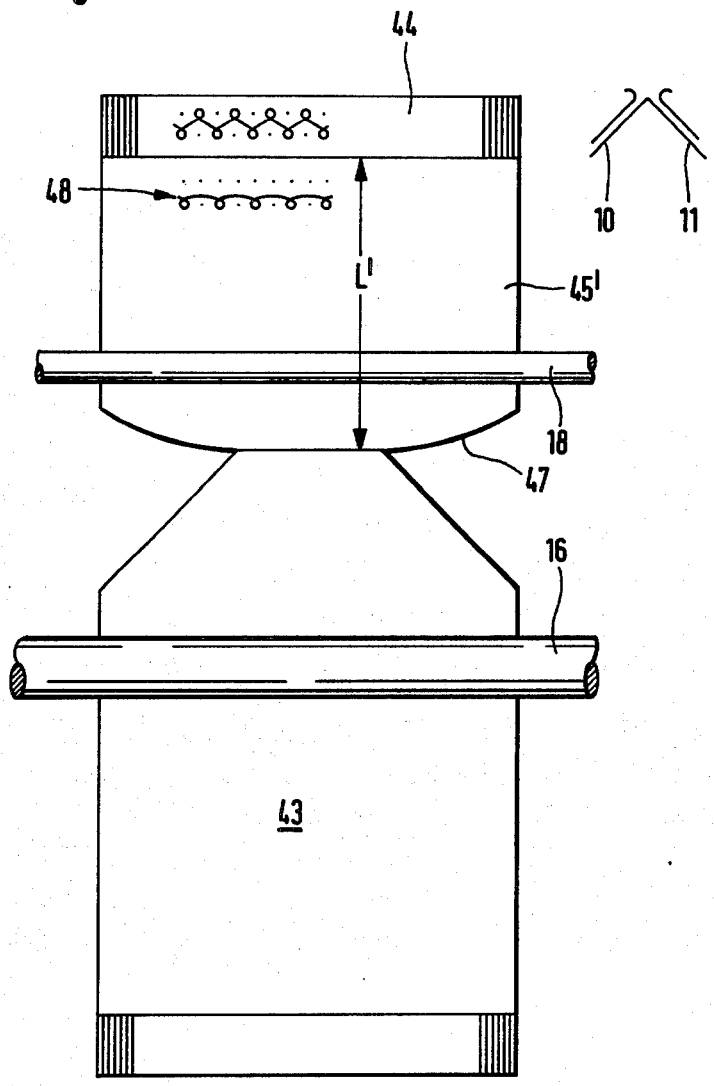
FIG. 4 is an illustration similar to that of FIG. 3 but showing the separating part engaged by the auxiliary take-down roller and after half of the selvedge stitches of the two-sided separating section have been pressed off.

FIGS. 3 and 4 diagrammatically show the main take-down roller 16 and the auxiliary take-down roller 18 and a first shaped fabric piece 43 engaged by this take-down mechanism, the marginal area 44 of a second and similar succeeding shaped knitted fabric piece and a separating section 45 and 45' of the knitted fabric connecting the first shaped fabric piece 43 with the next following shaped piece. The shaped knitted pieces 43 end in a narrow collar margin 46 on which the take-down force of the take-down mechanism is effective and is transmitted through the separating knitted section 45 to the substantially wider marginal section 44 of the next following shaped knitted piece. As a consequence of the fact that the take-down effect which is operative only over the narrow collar section margin 46 there is a contraction of the adjoining starting seam 47 of the separating knitted section 45, as can be seen from FIGS. 3 and 4. A corresponding pull on the wider marginal section 44 of the next following knitted piece must however be avoided and a distribution of the take-down force be achieved over the complete width of the marginal section 44.

As can be seen from the yarn illustrations of FIG. 3, both the shaped knitted piece 43 illustrated including its starting selvedge section part 44, as also the separating knitted section 45, are of double sided knit. In accordance with the invention, after knitting the last course of stitches of the separating knitted section 45, before the knitting of the selvedge section 44 of the next following shaped knitted piece the stitches on one of the two needle beds 10 or 11 are pressed off so as to provide the yarn structure 48 for this course of stitches shown in FIG. 4. After the pressing-off of these stitches the stitch roots are loosened under the action of the take-down force of the main take-down roller 16 and the auxiliary take-down roller 18, which means an increase in the length L of the separating knitted section 45 to the length L', about three times as much, indicated in FIG. 4. Because of the increased take-down speed imparted by the auxiliary take-down roller 18 the elongated knitted section 45', at first exerting practically no counter pull, is rapidly drawn off, delay originally present and visible in the separating knitted section is relieved and a uniform take-down force applied over the complete width of the adjoining marginal area 44 of the next shaped piece.

We claim:

1. A mechanism for flat knitting machines for taking down shaped knitted products having a driven main take-down roller and an auxiliary take-down roller which precedes the main roller in the take-down direction and is disposed adjacent the stitch formation area and cooperates with a press roller, this auxiliary take-down roller being coupled drivingly with the main take-down roller, characterised by the fact that the auxiliary take-down roller (18) is provided, with the object of acquiring a superimposed rotary motion, at least in the direction of take-down with an auxiliary driving device (29–35) which can be operated intermittently through a control arrangement and brought into action through a clutch (38) capable of assuming a free wheel status.

2. A mechanism accocding to claim 1, characterised by the fact that the auxiliary driving device is a motor (49) which acts through the clutch (50) directly on the auxiliary take-down roller (18) and the control arrangement acts on the motor (49) or the clutch (50).

3. A mechanism according to claim 1, characterised by the fact that the auxiliary driving device comprises a driving or control shaft (27) of the flat knitting machine and the auxiliary take-down roller (18) is directly or indirectly coupled therewith through at least one controlled clutch (30).

4. A mechanism according to claim 1, characterised by the fact that the auxiliary driving device for the auxiliary take-down roller (18) has at least one controlled electromagnetically-operated clutch (31–35).

5. A mechanism according to claim 1, characterised by the fact that the auxiliary driving device for the auxiliary take-down roller (18) includes at least one so-called loop spring clutch (30, 38).

6. On double bed flat knitting machines a method of taking down successive knitted fabrics connected to one another through separating knitted sections by means of a mechanism according to claim 1, characterised by the fact that (a) after a double-sided separating knitted section (45) has been made the stitches of the last course of stitches of the separating section made on one needle bed (10, 11) are pressed off (thread pattern illustration 48) and (b) that at the same time or following thereon the auxiliary driving device for the auxiliary take-down roller (18) is operated to produce an additional superimposed take-down rotation of the auxiliary take-down roller (18).

7. A method according to claim 6, characterised by the fact that the auxiliary driving device is intermittently operated (stop wheel 31).

* * * * *